US006702641B2

(12) United States Patent
Oakley

(10) Patent No.: US 6,702,641 B2
(45) Date of Patent: Mar. 9, 2004

(54) TOY BUILDING BLOCKS

(75) Inventor: Daniel R. Oakley, San Francisco, CA (US)

(73) Assignee: Oliblock, San Francisco, CA (US)

( * ) Notice: Subject to any disclaimer, the term of this patent is extended or adjusted under 35 U.S.C. 154(b) by 0 days.

(21) Appl. No.: 10/012,288

(22) Filed: Nov. 13, 2001

(65) Prior Publication Data

US 2003/0036333 A1 Feb. 20, 2003

Related U.S. Application Data

(60) Provisional application No. 60/270,069, filed on Feb. 20, 2001.

(51) Int. Cl.[7] ..... A63H 33/04; A63H 33/06; A63H 33/26

(52) U.S. Cl. ..... 446/92; 446/129; 446/120; 446/124

(58) Field of Search ..... 446/92, 120, 121, 446/122, 123, 124, 125, 126, 127, 128, 129, 137, 138, 139

(56) References Cited

U.S. PATENT DOCUMENTS 1,535,035 A * 4/1925 Philipp ..... 446/92
4,026,086 A * 5/1977 Langley ..... 52/592.6
4,509,929 A * 4/1985 Zawitz ..... 446/102
5,380,233 A * 1/1995 Numoto ..... 446/92
5,867,876 A * 2/1999 Petersen ..... 24/452
5,921,781 A * 7/1999 Shaw ..... 434/298
6,024,626 A * 2/2000 Mendelsohn ..... 446/92
6,062,937 A * 5/2000 Kikuchi ..... 446/91
6,083,077 A * 7/2000 McGinn ..... 446/309

* cited by examiner

*Primary Examiner*—Jacob K. Ackun
*Assistant Examiner*—Faye Francis
(74) *Attorney, Agent, or Firm*—Hovey Williams LLP

(57) ABSTRACT

A set of toy building blocks has several different basic block shapes with multiple numbers of each shape. Each block has a magnetic base at one end that enables the block to be attached magnetically to the base end of another block. Further, each block has one-half of a mechanical connection at its other end that is complemental to certain of the connectors on other blocks in the set. The mechanical connectors at one end of the blocks and the magnetic couplings at the other, together with a variety of different shapes, preferably of abstract form, permit a wide variety of toy structures to be created and erected in accordance with the child's imagination and creativity.

36 Claims, 4 Drawing Sheets

TOY BUILDING BLOCKS

CROSS-REFERENCE TO RELATED APPLICATION

This application claims the priority benefit of Provisional Application Ser. No. 60/270,069 filed Feb. 20, 2001, titled "Interfacing Toy Building Blocks," said Provisional Application being hereby incorporated by reference into the present application.

TECHNICAL FIELD

This invention relates to toys and, more particularly, to toy building blocks that a child can quickly and easily releasably join together to create structures and objects of various shapes and sizes as an expression of the child's imagination and creative spirit.

BACKGROUND AND SUMMARY

Toy building blocks that interlock with one another so children can construct and create various types of toy structures, creatures, and other things are well known in the art. Many have enjoyed significant commercial success. However, conventional blocks tend to have rather common, symmetrical shapes that leave little to the imagination.

The present invention contemplates providing a set of abstractly shaped toy blocks that assume a number of different "organic" shapes and forms and which, despite such unusual configurations, are adapted to be selectively and releasably joined together either by mechanical interfitting connections or by magnetic attraction. In a preferred form of the invention, several block shapes are contemplated, and each shape is replicated several times over to provide a complete set that contains multiple numbers of the several different shapes.

Each block has one-half of a particular mechanical interfitting connection at one end and one-half of a magnetic coupling at its other end. Several different types of interconnections are provided, with certain blocks having one-half of the interconnection and others the remaining half. All blocks are provided with magnetic ends, but some of the blocks have magnetic ends of one polarity and others have magnetic ends of the opposite polarity so some blocks repel one another while others attract one another. In a preferred form of the invention, the magnetic end of each block has a substantially flat base so that each block can be free-standing, if desired, when oriented with its base resting upon a supporting surface. In the alternative, the flat bases of any two blocks may be applied in face-to-face engagement with one another so as to attach the two blocks together magnetically when their polarities are mutually opposite.

The blocks are preferably constructed from a synthetic resinous material such as polyvinyl chloride to present a firm, smooth feel that is pleasing to the touch and comfortable to handle. The polyvinyl chloride material has a slight compressibility and resilience that is beneficial when the interfitting ends of some of the blocks are snapped together so as to maintain a relatively secure interconnection. Yet, the blocks can be easily snapped apart by young hands.

One of the blocks has, as its preferred form, a shape that is abstractly suggestive of a stooped or hunched over man, having a main trunk portion that projects from the flat base, a stooped or angled over neck at the upper end of the trunk, and an arcuately contoured head or bulb at the outer end of the neck. A second abstractly shaped block is suggestive of a cup or goblet, having a lower, generally conical trunk projecting from a flat base, a neck at the upper end of the trunk, and a cup at the upper end of the neck that is configured complementally to the bulb of the man style block so that the bulb can be interfitted within the cup to form a releasable, mechanical connection between the two pieces. The fit between the bulb and the cup is such as to permit the bulb to be rotated fairly freely such that the two pieces can be disposed at any number of different oblique angles relative to one another.

A third style of block is abstractly suggestive of a tripod and presents a generally conical trunk projecting upwardly from a flat base, a neck portion at the upper end of the tapering trunk, and an inverted tripod at the upper end of the neck. The three different legs of the tripod are provided with bulbs at their distal ends that are complementally shaped with respect to the receiving cup of the cup style block. Thus, any selected one of the legs may be interfitted into the cup to establish a releasable interconnection between the two pieces, which can also be rotated freely as in a ball and socket joint. Webbing between the legs of the tripod is so configured that the tripods of two different pieces can be snapped into interfitted relationship with one another to establish a releasable interconnection of the two pieces. The tripods can also serve as a means of supporting the block on a flat supporting surface, if desired.

A fourth style of block is abstractly suggestive of a tooth and has a generally cylindrical trunk that rises from the flat base, capped by a series of axially projecting, symmetrical, laterally spaced, tapered teeth. When the teeth of one block are interfitted between the teeth of another, the two blocks are interconnected by the teeth against rotation relative to one another. All of the blocks may be supplied in various colors to enhance their aesthetic appeal.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
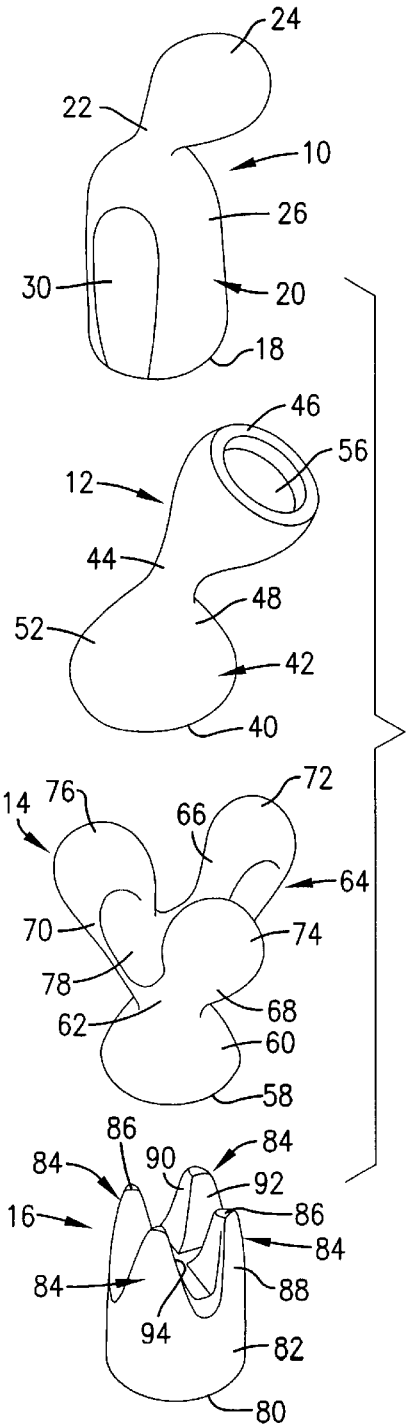
FIG. 1 is a collection of perspective views of four different styles of toy blocks constructed in accordance with the principles of the present invention.
Figure 2:
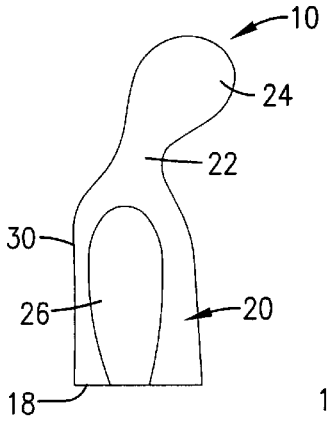
FIG. 2 is a side elevational view of a stooping man block from FIG. 1.
Figure 3:
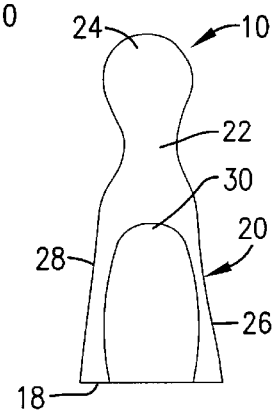
FIG. 3 is a rear elevational view of a stooping man block.
Figure 4:
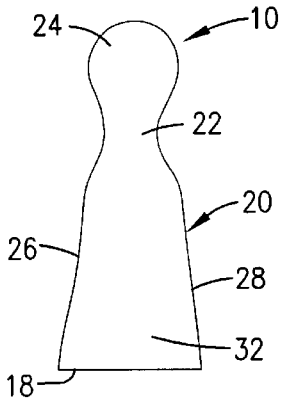
FIG. 4 is a front elevational view of a stooping man block.
Figure 5:
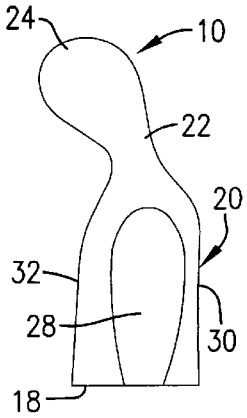
FIG. 5 is an opposite side elevational view of a stooping man block.
Figure 6:
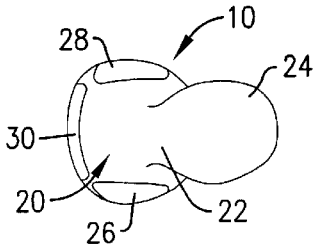
FIG. 6 is a top plan view of a stooping man block.

In one preferred embodiment of the invention, a set of blocks includes four different styles of blocks, a full set including multiple copies of each style. As shown in FIG. 1, the four exemplary styles include a stooping man style block 10, a cup style block 12, a tripod style block 14, and a tooth style block 16. As will be seen, each of these pieces has one-half of a mechanical interfitting connection at one end and one-half of a magnetic coupling at the other end so that the pieces may be joined together in countless combinations and configurations, limited only by the child's imagination and creativity.

The man block 10 comprises an abstractly shaped body having a flat base 18 at one end, a trunk 20 projecting upwardly from base 18, a reduced dimension neck 22 projecting from trunk 20, and a head or bulb 24 located at the distal end of neck 22. Trunk 20 tapers very gradually toward neck 22 and is provided with a pair of generally flat opposite sides 26 and 28, a slightly rounded back 30, and a slightly rounded front 32. Neck 22 slopes upwardly and forwardly at an oblique angle from the upper end of trunk 20 so as to dispose bulb 24 in forwardly overhanging relationship to the front 32 of the body.

Bulb 24 is somewhat teardrop-shaped, having its largest width at the upper outboard end thereof while its lower inboard end tapers somewhat symmetrically inwardly to a reduced diameter at the junction with neck 22. Bulb 24 comprises one-half of a mechanical connection formed when bulb 24 is interfitted into a mating component as will be discussed below.

Figure 24:
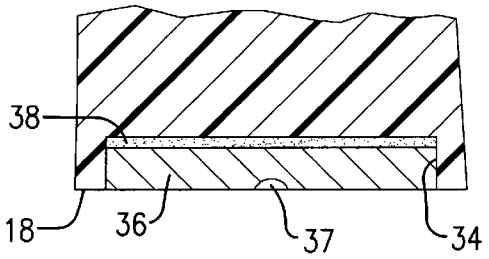
FIG. 24 is an enlarged, fragmentary cross-sectional view of the magnetic end of a typical block in accordance with the present invention illustrating details of construction.

The body of man block 10 is integrally molded from a suitable synthetic resinous material such as toy grade polyvinyl chloride, the characteristics and composition of such material being well understood by those of ordinary skill in this art. Advantageously, the block 10 may be injection molded and provided with a smooth, solid, yet slightly resilient body. A suitable pigment may be added for increased appeal. A recess 34 in base 18 (FIG. 24) fixedly receives a disc magnet 36 that is secured in place by a suitable layer of bonding material 38. Disc magnet 36 is flush with the exposed surface of base 18 and comprises one-half of a magnetic coupling formed when the bases of two of the blocks are brought into face-to-face engagement with one another.

Figure 7:
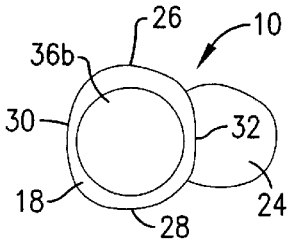
FIG. 7 is a bottom plan view of a stooping man block illustrating a magnet of one polarity in the base of the block.
Figure 8:
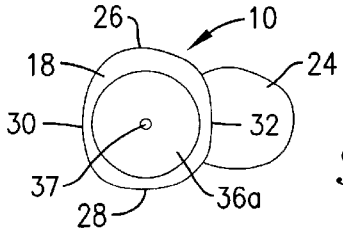
FIG. 8 is a bottom plan view of another stooping man block illustrating a magnet of the opposite polarity in the base of the block.
Figure 9:
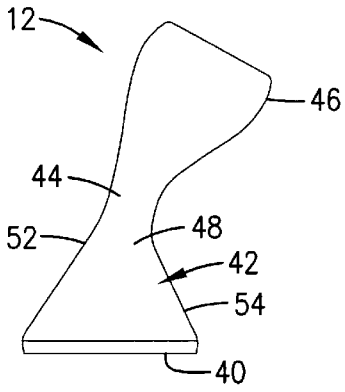
FIG. 9 is a side elevational view of a cup style block from FIG. 1.
Figure 10:
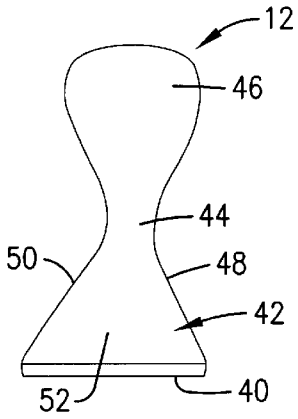
FIG. 10 is a rear elevational view of a cup block.
Figure 11:
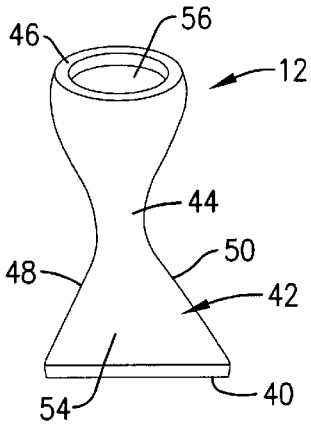
FIG. 11 is a front elevation view of a cup block.
Figure 12:
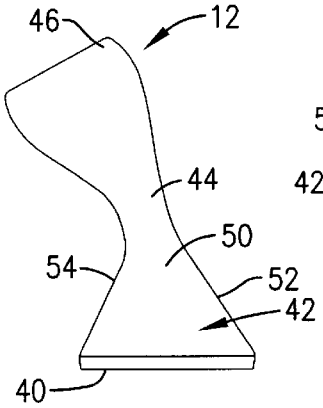
FIG. 12 is an opposite side elevational view of a cup block.
Figure 13:
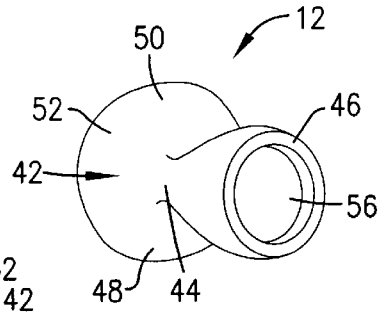
FIG. 13 is a top plan view of a cup block.
Figure 14:
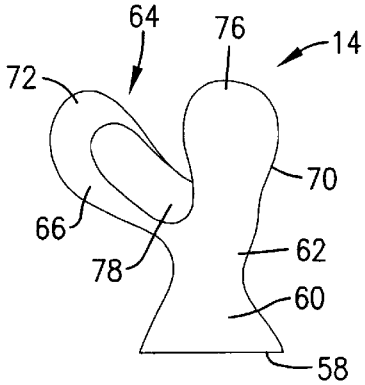
FIG. 14 is a side elevational view of a tripod style block from FIG. 1.
Figure 15:
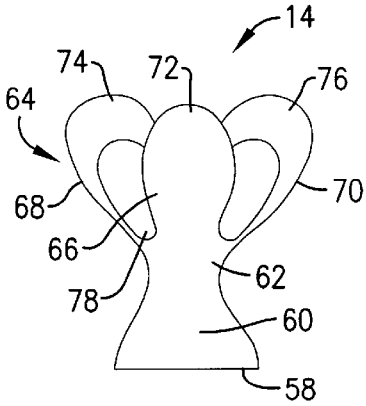
FIG. 15 is a front elevational view of a tripod block.
Figure 16:
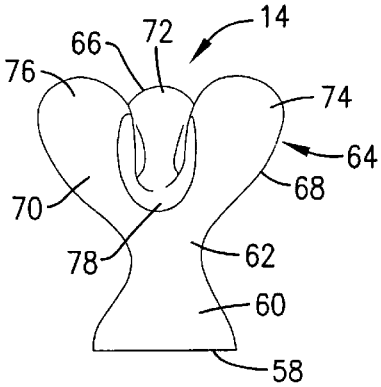
FIG. 16 is a rear elevational view of a tripod block.
Figure 17:
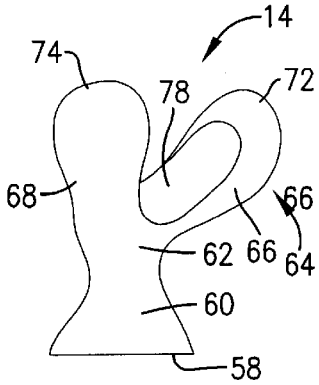
FIG. 17 is an opposite side elevational view of a tripod block.
Figure 18:
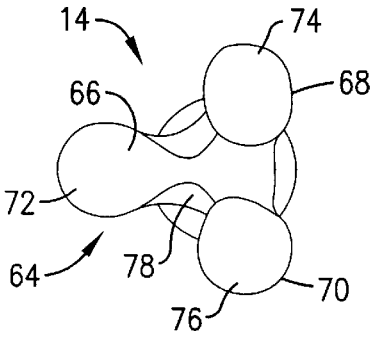
FIG. 18 is a top plan view of a tripod block.

Although the magnetic coupling can take several different forms including, for example, a simple magnet in one-half of the coupling and a ferrous metal component in the other half, in one preferred form of the invention the coupling comprises two magnets having mutually opposite polarities. Thus, as illustrated in FIGS. 7 and 8, two of the disc magnets 36*a* and 36*b* comprise the separate halves of a magnetic coupling and are of mutually opposite polarity, each of the magnets having a suitable indication of its polarity such as, for example, a dot 37 on the magnet 36*a* and a smooth dot-free surface on the magnet 36*b*. It is to be understood that, in accordance with one preferred embodiment of the invention, a number of the man blocks 10 will be provided with magnetic bases that are of one polarity, while another group of the man blocks 10 will be provided with bases of opposite polarity. Thus, a pair of the man blocks 10 may be magnetically coupled together at their bases, provided only that one of the bases is positive and the other is negative.

Depending upon the strength of the magnets used, it may be necessary or desirable to somewhat reduce the weight of the block 10. This may be accomplished, for example, by providing a void or hollow space (not shown) internally of the block, such as within its trunk adjacent the recess 34. The size and shape of any such recess must be such as to avoid adversely impacting the structural integrity and strength of the product, however. Desirably, the strength of the magnets is such as to permit young children to easily disconnect the magnets from one another and yet securely hold a pair of the blocks together.

A second piece in the set is the cup block 12 which, like the man block 10, has one half of a magnetic coupling at one end and one half of a mechanical connection at another end. Cup block 12 has a flat base 40, a trunk 42 projecting upwardly from base 40 that takes the form generally of an asymmetrical cone, a neck 44 of reduced dimensions projecting upwardly from the upper end of trunk 42, and a cup 46 disposed at the upper distal end of neck 44. Although the surface of trunk 42 is substantially arcuate throughout a full 360° degrees thereof, trunk 42 still presents a pair of opposite sides 48 and 50, a back 52, and a front 54. It will thus be seen that the body of cup block 12 leans slightly toward side 48 as neck 44 projects upwardly from trunk 42 at a slight lean angle from side-to-side. Additionally, neck 44 leans slightly forwardly at an oblique angle so as to position cup 46 out into overhanging relationship with the front 54 of trunk 42.

Figure 25:
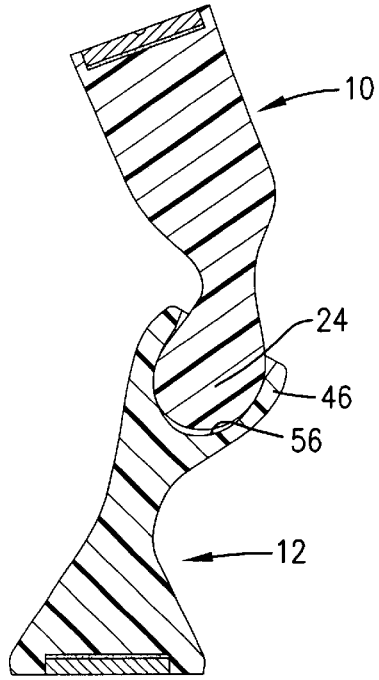
FIG. 25 is a longitudinal cross-sectional view of a man block and a cup block mechanically interfitted together.

Cup 46 has a socket 56 that is configured to complementally and matingly receive a connecting bulb such as bulb 24 of man block 10 (see FIG. 25, for example). The configuration of socket 56 is such that bulb 24 is snugly received and held therein when man block 10 and cup block 12 are interconnected, yet bulb 24 is free to rotate within socket 56 such that the rotative positions of the two blocks can be varied with respect to one another. Preferably, when bulb 24 is inserted into socket 56, there is a slight snap fit, achieved in part by the relative configurations of bulb 24 and socket 56 and in part by the nature of the material from which the blocks are constructed. In this respect, it is desirable that such material be slightly compressively resilient so that the walls of cup 46 can yield slightly as necessary to accommodate the bulb 24 as it is inserted into place.

Like the man block 10, cup block 12 is integrally molded from a suitable synthetic resinous material such as polyvinyl chloride and has a magnet bonded within a recess such as the magnet 36 and recess 34. Also like the man block 10, cup block 12 is preferably provided in multiples within a set of the blocks, certain of those cup blocks having magnetic bases of one polarity and others having magnetic bases of the opposite polarity. Thus, pairs of the cup blocks 12 can be attached together at their bases 40 when the bases are of opposite polarity.

A third style is the tripod block 14, which has one-half of a magnetic coupling at one end and one-half of a mechanical connection at the other end. The body of tripod block 14 includes a flat base 58, a generally symmetrically conical trunk 60 projecting upwardly from base 58, a neck 62 projecting from the upper end of trunk 60, and a tripod 64 projecting from the distal end of neck 62. Three legs 66, 68 and 70 diverge from the upper end of neck 62 toward outermost ends that are configured in the shape of bulbs 72, 74 and 76 respectively.

Figure 26:
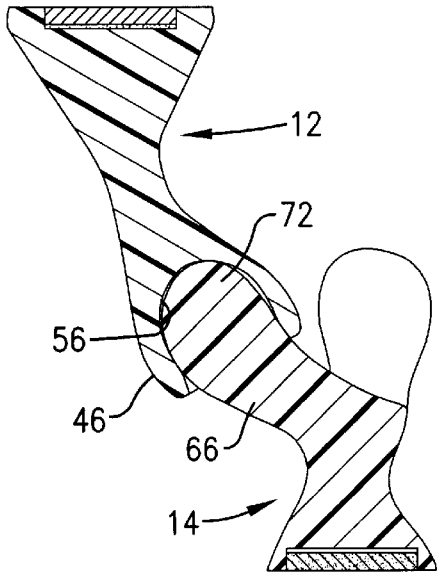
FIG. 26 is a longitudinal cross-sectional view of a cup block and a tripod block mechanically interfitted together.

Each of the bulbs 72, 74 and 76 is configured complementally to the socket 56 of cup 46 of cup block 12 such that any selected one of the bulbs 72, 74 and 76 may be releasably snapped into cup 46 (see, for example, FIG. 26). It will be seen, therefore, that bulbs 72, 74 and 76 are substantially of the same configuration as the bulb 24 of man block 10.

The two legs 68 and 70 of tripod 64 are offset from one another approximately 180° degrees. On the other hand, the third leg 66 is offset from legs 68 and 70 by only approximately 90° degrees. Moreover, leg 66 is somewhat longer than legs 68 and 70 and projects from neck 62 at a shallower angle than legs 68 and 70. Notwithstanding the fact that leg 66 is longer than legs 68, 70 and projects at a shallower angle, the outermost ends of bulbs 72, 74 and 76 lie in a common plane that is close to being parallel with the plane of base 58. Consequently, when tripod block 14 is inverted with its base 58 up and the bulbs of the tripod 64 resting upon a level supporting surface, the base 58 is likewise almost or at least substantially level so as to provide a convenient and stable platform from which to erect variously shaped structures that rise from base 58.

Like the previously described blocks, tripod block 14 has a recess in its base that fixedly receives a magnet to which other blocks having bases of an opposite polarity may be attached. It is contemplated that multiples of the tripod blocks 14 will be included in each set of blocks, some having bases of one polarity and others of the opposite polarity such that a pair of the tripod blocks can be magnetically attached together at their bases when opposite polarities are selected.

Figure 19:
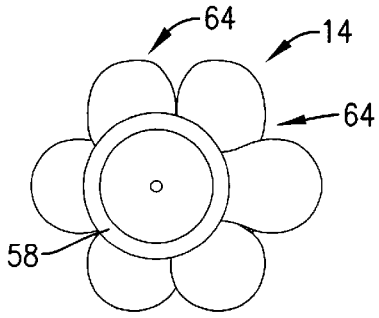
FIG. 19 is a bottom plan view of a pair of tripod blocks interconnected to one another by interfitting their legs together.
Figure 20:
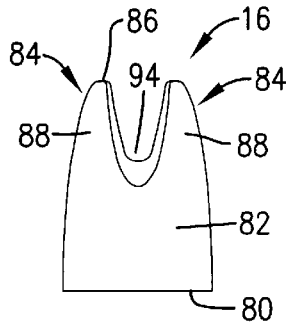
FIG. 20 is a side elevational view of a tooth style block from FIG. 1.
Figure 21:
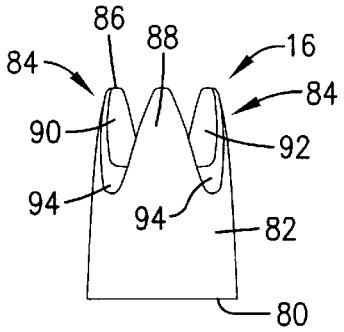
FIG. 21 is another side elevation view of a tooth block rotated 45° from the position of FIG. 20.
Figure 22:
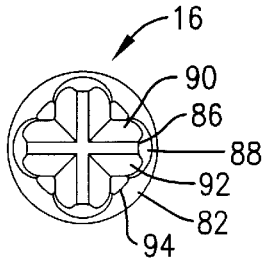
FIG. 22 is a top plan view of a tooth block.
Figure 23:
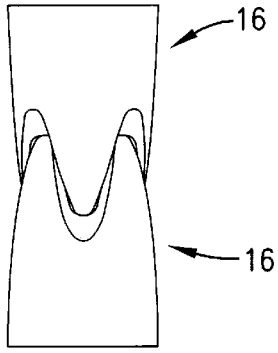
FIG. 23 is a side elevational view of a pair of tooth blocks interconnected with one another.
Figure 27:
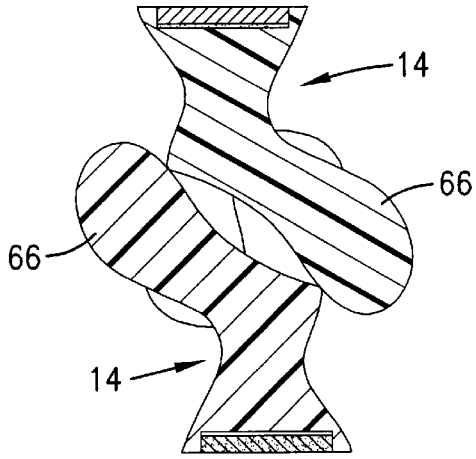
FIG. 27 is a longitudinal cross-sectional view of a pair of tripod block mechanically interfitted together.

In one preferred form of the invention, legs 66, 68 and 70 are so configured that tripods 64 of adjacent tripod blocks may be mutually interconnected as shown in FIGS. 19 and 27 wherein the legs of one tripod are interdigitated between the legs of the other. Preferably, webbing 78 between the various tripod legs is configured, arranged and dimensioned such that when the legs of the two tripods are interdigitated, there is a relatively snug fit therebetween without excessive looseness or relative rotation permitted. The enlarged nature of bulbs 72, 74 and 76 at the outer ends of legs 66, 68 and 70 relative to the somewhat narrower inner ends of such legs is helpful in obtaining a light snap fit when the two tripod blocks are forced axially into interfitting engagement with one another.

As with the previously described blocks, the tripod style block 14 is preferably integrally molded from a synthetic resinous material such as polyvinyl chloride. In one preferred form, tripod block 14, like the others, is essentially solid, except perhaps for certain void areas (not shown) which may be provided adjacent or at the trunk to provide weight control. The slightly compressively resilient nature of tripod legs 66, 68 and 70, coupled with the nature of the material used for tripod block 14, helps in establishing a snap fit interconnection of a pair of tripods into one another.

While in a preferred form of the invention the tripods can be interengaged in any selected one of three rotative positions, it will be appreciated that when the tripods are interengaged with the long legs 66 diametrically opposed to one another, the flat bases 58 of the two interengaged blocks become disposed in substantially parallel relationship to one another. This provides a number of benefits and construction opportunities.

The fourth style of block in the set is the symmetrical tooth block 16 which, like the other previously described blocks, is adapted for magnetic coupling at one end and mechanical connection at the other end. The body of tooth block 16 includes a flat base 80, a generally cylindrical trunk 82 projecting upwardly from base 80, and a group of axially extending, symmetrical, laterally spaced apart, tapered teeth 84 at the upper end of trunk 82. In one preferred form of the invention, fourteeth are provided at substantially equally spaced intervals about the circumference of trunk 82. Each tooth 84 tapers to a generally pointed tip 86 that is rounded off or blunted to avoid the presence of a sharp corner. Each tooth is somewhat prism-shaped, having an outermost curved face 88 and a pair of generally flat, triangular, upwardly converging inner faces 90 and 92. Notches 94 are defined between the spaced apart teeth 84.

Like the previously described blocks, tooth blocks 16 are preferably integrally molded from a synthetic resinous material such as polyvinyl chloride and are substantially solid throughout. Furthermore, each is provided with an inset magnet, with certain of the tooth blocks having magnets of one polarity and others having magnets of the opposite polarity so that a pair of the tooth blocks can be attached together magnetically at their bases. In addition, a pair of the tooth blocks can be mechanically interconnected at their opposite ends by inserting the teeth 84 of one block into the notches 94 of the other. In one preferred embodiment, the teeth and notches are so configured that the two blocks do not lock up against axial displacement; however, they do preclude relative rotation of the blocks due to the interfitting nature of the teeth and notches.

Various polymeric based compositions are suitable for making the blocks of the present invention. Particularly suitable is a composition containing approximately 67.00% by weight suitable polyvinyl chloride resin, approximately 24.00% by weight suitable plasticizer, approximately 3.50% by weight suitable stabilizer, approximately 3.50% by weight suitable epoxy, approximately 1.00% by weight suitable processing addivitves, approximately 0.50% by weight suitable lubricant, and approximately 1.00% by weight suitable modifier. One particularly preferred polyvinyl chloride resin is available from Shin-Etsu Chemical Co., Ltd. of Tokyo, Japan under the trade designation TK-1000. One particularly preferred plasticizer is phthalate, such as available under the trade designation JAYFLEX DINP from Exxon Chemical Company. A particularly preferred stabilizer is MARK CZ 123 available from Witco Vinyl Additives GmbH of Lampertheim, Germany. A particularly preferred epoxy is epoxidised soya bean oil available from Ciba-Geigy Corporation of Tarrytown, N.Y. under the trade designation IRGAPLAST 39 or from Witco Vinyl Additives GmbH of Lampertheim, Germany under the trade designation DRAPEX 39. The processing additives, lubricant and modifier may be selected from a wide variety of brands and sources, as well known to those skilled in the art. Preferably, the material from which the blocks are made has a Shore hardness of about 90 to about 95 durometer on the A scale.

Operation

Figure 28:
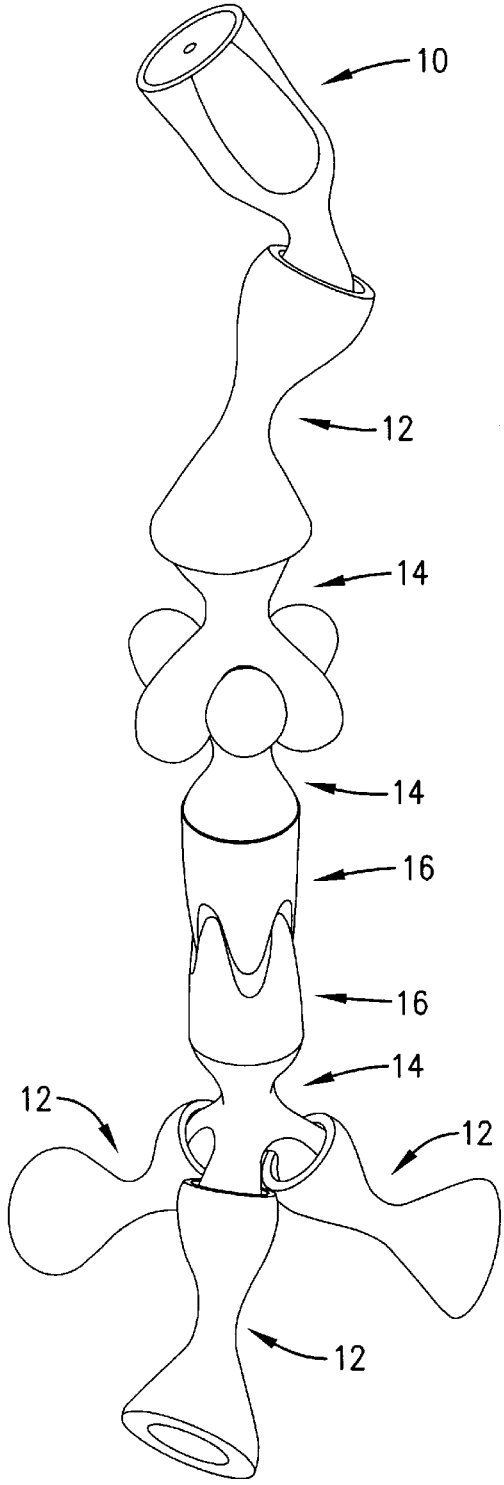
FIG. 28 is a perspective view of one exemplary structure out of a countless number of possible structures that can be formed by interconnecting and magnetically coupling together toy blocks in accordance with the present invention.

The abstractly shaped blocks of the present invention can be combined in any number of creative ways to allow and encourage children to express themselves freely. Animals, creatures, people, and structures of various shapes and sizes can all be formed, limited only by the imagination. One very simple structure, representing no entity in particular, is illustrated in FIG. 28 to provide but one example of how the blocks of the present invention can be mechanically interconnected or magnetically coupled together, or both.

Although preferred forms of the invention have been described above, it is to be recognized that such disclosure is by way of illustration only, and should not be utilized in a limiting sense in interpreting the scope of the present invention. Obvious modifications to the exemplary embodiments, as 3 hereinabove set forth, could be readily made by those skilled in the art without departing from the spirit of the present invention.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What is claimed is:

1. A set of toy building blocks comprising:

a first block and a second block releasably joined together by a releasable interconnection, said first block being provided with one interfitting half of said releasable interconnection at one end and one half of a releasable magnetic coupling at another end, said second block being provided with a second interfitting half of said releasable interconnection at one end and a second half of said magnetic coupling at another end, said releasable interconnection halves being only at said one ends of the blocks, and said magnetic coupling halves being only at said another ends of the blocks.

2. A set of toy building blocks as claimed in claim 1, each half of the magnetic coupling including a substantially flat base.

3. A set of toy building blocks as claimed in claim 2, said one half and said second half of the magnetic coupling including a pair of magnets having mutually opposite polarities.

4. A set of toy building blocks as claimed in claim 1, said one half and said second half of the magnetic coupling including a pair of magnets having mutually opposite polarities.

5. A set of toy building blocks as claimed in claim 1, said one interfitting half including an outwardly projecting bulb, said second interfitting half including a cup for complementally receiving said bulb, said cup being slightly undersized with respect to said bulb and being constructed from a material that permits the cup to resiliently expand and snugly retain the bulb when the bulb is forced into the cup.

6. A set of toy building blocks as claimed in claim 5, said material comprising a synthetic resinous material.

7. A set of toy building blocks as claimed in claim 6, said synthetic resinous material comprising polyvinyl chloride.

8. A set of toy building blocks as claimed in claim 1, said one interfitting half including a first tripod having legs that diverge generally outwardly at said one end of the first block, said second interfitting half including a second tripod having legs that diverge generally outwardly at said one end of the second block.

9. A set of toy building blocks comprising:

a first block and a second block releasably joined together by a releasable interconnection, said first block being provided with one interfitting half of said releasable interconnection at one end and one half of a releasable magnetic coupling at another end, said second block being provided with a second interfitting half of said releasable interconnection at one end and a second half of said magnetic coupling at another end, said one interfitting half including a first tripod having legs that diverge generally outwardly at said one end of the first block, said second interfitting half including a second tripod having legs that diverge generally outwardly at said one end of the second block, each of said tripods having three legs provided with webbing therebetween configured and sized to provide a snug fit between the interdigitated legs of the two tripods when the two tripods are interfitted together.

10. A set of toy building blocks as claimed in claim 9, each of said legs having a bulb at an outer end thereof, said bulbs being operable to assist in releasably retaining a pair of the tripods held together against axial separation.

11. A set of toy building blocks as claimed in claim 10, each of said tripods being constructed from a material that permits the tripods to resiliently yield as the tripods are interfitted together and disengaged from one another.

12. A set of toy building blocks as claimed in claim 11, said material comprising a synthetic resinous material.

13. A set of toy building blocks as claimed in claim 12, said synthetic resinous material comprising polyvinyl chloride.

14. A set of toy building blocks comprising:

a first block and a second block releasably joined together by a releasable interconnection, said first block being provided with one interfitting half of said releasable interconnection at one end and one half of a releasable magnetic coupling at another end, said second block being provided with a second interfitting half of said releasable interconnection at one end and a second half of said magnetic coupling at another end, said one interfitting half including a plurality of axially projecting, laterally spaced teeth, said second interfitting half including a plurality of axially projecting, laterally spaced teeth configured and disposed to mate with the teeth of the one interfitting half.

15. A set of toy building blocks as claimed in claim 14, said teeth of the one interfitting half and the second interfitting half each tapering toward a generally pointed tip.

16. A toy building block comprising a body provided with an outwardly projecting bulb at one end and a magnetic coupling part at another end, said body including a substantially flat base, a main trunk projecting from the base, a neck projecting from the trunk, and said bulb on the distal end of the neck.

17. A toy building block as claimed in claim 16, said neck projecting from said trunk generally at an oblique angle.

18. A toy building block as claimed in claim 17, said base having said magnetic coupling part.

19. A toy building block as claimed in claim 18, said body being constructed from a synthetic resinous material.

20. A toy building block comprising a body provided with a cup at one end and a magnetic coupling part at another end, said body including a substantially flat base, a main trunk projecting from the base, a neck projecting from the trunk, and said cup on the distal end of the neck.

21. A toy building block as claimed in claim 20, said neck projecting from said trunk generally at an oblique angle.

22. A toy building block as claimed in claim 21, said base having said magnetic coupling part.

23. A toy building block as claimed in claim 22, said body being constructed from a synthetic resinous material.

24. A toy building block as claimed in claim 20, said trunk being generally conical.

25. A toybuilding block comprising a body provided with a tripod at one end and a magnetic coupling part at another end, said tripod having legs that diverge generally outwardly at said one end of the block, said body including a substantially flat base, a trunk projecting from said base, a neck projecting from the trunk, and said tripod at the distal end of the neck.

26. A toy building block as claimed in claim 25, said base having said magnetic coupling part.

27. A toy building block as claimed in claim 25, said tripod including three legs that diverge from said distal end of the neck, each of said legs having a bulb at an outermost end thereof.

28. A toy building block as claimed in claim 27, two of said legs being disposed approximately 180° apart, the third leg being disposed approximately 90° from each of said two legs.

29. A toy building block as claimed in claim 28, each of said two legs projecting outwardly from the neck at approximately the same angle, said third leg projecting outwardly from the neck at a greater angle than the two legs and being longer than the two legs, all three of said legs having outermost terminations located in a plane that is generally parallel to the plane of the flat base of the body.

30. A toy building block as claimed in claim 29, said body being constructed from a synthetic resinous material.

31. A toy building block as claimed in claim 25, said trunk being generally conical.

32. A set of toy building blocks comprising:

a plurality of first blocks having a flat magnetic base at one end and an interfitting bulb at another end, a plurality of the magnetic bases of the first blocks being of mutually opposite polarity;

a plurality of second blocks having a flat magnetic base at one end and an interfitting cup at another end configured complementally to the bulbs of the first blocks, a plurality of the magnetic bases of the second blocks being of mutually opposite polarity;

a plurality of third blocks having a flat magnetic base at one end and an interfitting tripod at another end, said tripods of the third blocks being mutually complementally configured to permit pairs of the third blocks to be interconnected with one another by interfitting their respective tripods, each of said tripods being provided with three legs having an interfitting bulb at a distal end thereof that is configured complementally to the cups of the second blocks, a plurality of the magnetic bases of the third blocks being of mutually opposite polarity; and a plurality of fourth blocks having a flat magnetic base at one end and an interfitting group of axially projecting, laterally spaced teeth at another end, said teeth of the fourth blocks being mutually complementally configured to permit pairs of the fourth blocks to be interconnected with one another by interfitting their respective groups of teeth, a plurality of the magnetic bases of the fourth blocks being of mutually opposite polarity.

33. A set of toy building blocks as claimed in claim 32, said blocks being constructed from a synthetic resinous material.

34. A set of toy building blocks as claimed in claim 33, said synthetic resinous material comprising polyvinyl chloride.

35. A set of toy building blocks as claimed in claim 32, said magnetic bases of the blocks being provided with visually perceivable indications of their polarity.

36. A set of toy building blocks as claimed in claim 35, said visually perceivable indications of polarity including indicia on bases of one polarity and a lack of indicia on bases of the opposite polarity.

* * * * *